US008322088B2

(12) United States Patent
Huang

(10) Patent No.: US 8,322,088 B2
(45) Date of Patent: Dec. 4, 2012

(54) VENTILATED ROOFING STRUCTURE

(76) Inventor: Daniel C. L. Huang, Taichung (TW)

( * ) Notice: Subject to any disclaimer, the term of this patent is extended or adjusted under 35 U.S.C. 154(b) by 410 days.

(21) Appl. No.: 12/590,223

(22) Filed: Nov. 4, 2009

(65) Prior Publication Data

US 2011/0099924 A1 May 5, 2011

(51) Int. Cl.
*E04B 7/00* (2006.01)

(52) U.S. Cl. ..... 52/198; 52/11; 52/95; 52/302.3; 454/365; 454/366

(58) Field of Classification Search ..... 52/11, 94, 52/95, 199, 302.1–302.6, 716.2; 454/364–368
See application file for complete search history.

(56) References Cited

U.S. PATENT DOCUMENTS 5,593,348 A * 1/1997 Rickert ..... 454/365
7,694,467 B2 * 4/2010 Lin ..... 52/199

* cited by examiner

*Primary Examiner* — William Gilbert
*Assistant Examiner* — Patrick Maestri

(57) ABSTRACT

A ventilated roofing structure includes a modular roofing panel unit adapted to form part of an outermost layer of a roof, a wall unit which is secured to the roofing panel unit, and which extends downwardly to terminate at an anchored end to partition a space under the roof into outside and inside spaces, and which has a ventilation opening communicating the inside and outside spaces, and a modular drainage-route forming panel unit which is fastened to an overhanging eave of the roofing panel unit to form a gap therebetween. The drainage-route forming panel unit extends downwards to separate the outside space into an airflow transit chamber and an outdoor space, and has an anchoring edge secured to the anchored end, and a drainage port communicating the airflow transit chamber with the outdoor space.

10 Claims, 7 Drawing Sheets

VENTILATED ROOFING STRUCTURE

BACKGROUND OF THE INVENTION

1. Field of the Invention

This invention relates to a ventilated roofing structure, more particularly to a naturally ventilated roofing structure.

2. Description of the Related Art

Referring to FIG. 1, a conventional attic ventilation structure 11 is adapted to be mounted on a roof of a building with two base panels 111, and includes two support panels 112 extending upwardly from the base panels 111, and two roof panels 113 respectively fastened to the support panels 112 and spaced apart from the support panels 112 to respectively form two vent ports 115. Thus, heat inside the building can be exhausted out of the building through a ventilation opening 114 formed in the base panels 111 and the vent ports 115 by the combined effect of wind and thermal buoyancy forces. However, rainwater may splatter and enter the building through the vent ports 115, as indicated by hollow arrows in FIG. 1.

Referring to FIG. 2, another conventional ventilation device 12 is shown to include a base wall unit 121, a side wall unit 122, a roofing panel unit 123, and a water collecting tank 124. The base wall unit 121 includes two base panels 125 which are connected to each other at upper ends thereof and which cooperatively define a communicating opening 126. The side wall unit 122 is disposed on the base panels 125, and includes two side panels 128 that extend uprightly and two tilt panels 129 that extend toward each other. The roofing panel unit 123 is secured on the side wall unit 122, and includes a roof panel 100 which cooperates with the tilt panels 129 to define an S-shaped first ventilating duct 101. The water collecting tank 124 is disposed below the communicating opening 126, and cooperates with the base panels 125 to define an S-shaped second ventilating duct 102. Heat (as indicated by the dash arrows in FIG. 2) inside a building can be exhausted through the S-shaped second ventilating duct 102 and the S-shaped first ventilating duct 101. Besides, rainwater (as indicated by the hollow arrows in FIG. 2) which enters via the first ventilating duct 101 may fall into the water collecting tank 124 through the communicating opening 126. However, since the heat is exhausted along long and curved paths defined by the first and second ventilating ducts 101, 102, the heat dissipation effect is not satisfactory. In addition, by provision of the tilt panels 129 that project from the side panels 128, the structure of the conventional ventilation device 12 is weak and complicated, so that it is liable to be destroyed by strong winds and is costly to fabricate.

Referring to FIG. 3, still another conventional ventilation device 13 is shown to include an upright panel 131 and an eave panel 132. The upright panel 131 is configured to form part of a wall of a building, and has a ventilation window 133. The eave panel 132 is secured to an upper portion 134 of the upright panel 131 above the ventilation window 133 for baffling rainwater. However, rainwater may splatter and enter the building through the ventilation window 133, as indicated by hollow arrows in FIG. 3.

SUMMARY OF THE INVENTION

The object of the present invention is to provide a ventilated roofing structure which can prevent entry of rainwater while ensuring good ventilation, which has a relatively high structural strength, and which is inexpensive to fabricate.

According to this invention, the ventilated roofing structure includes a modular roofing panel unit, a wall unit, and a modular drainage-route forming panel unit. The roofing panel unit is adapted to form part of an outermost layer of a roof, and extends outwardly and downwardly to cover a space thereunder and to terminate at an overhanging eave. The wall unit is secured to the roofing panel unit distal from the overhanging eave, and extends downwardly to terminate at an anchored end so as to partition the space under the roof into outside and inside spaces. The wall unit has a ventilation opening extending to communicate the inside and outside spaces. The drainage-route forming panel unit has an upper end fastened to the overhanging eave such that a gap is formed between the drainage route forming panel unit and the overhanging eave. The drainage-route forming panel unit extends downwards to separate the outside space into an airflow transit chamber and an outdoor space, and terminates at an anchoring edge which is secured to the anchored end. The drainage-route forming panel unit has a drainage port extending to communicate the airflow transit chamber with the outdoor space.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
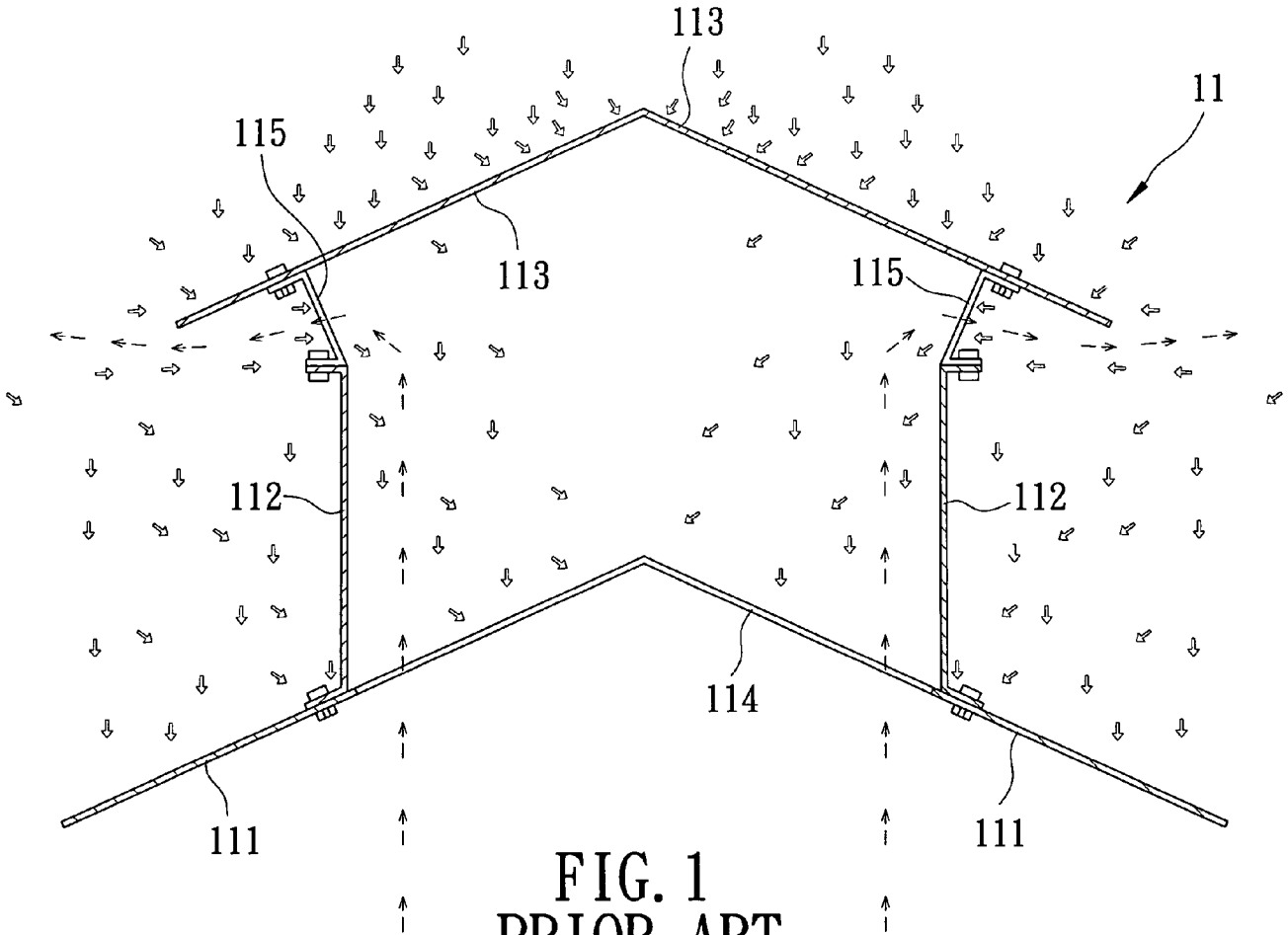
FIG. 1 PRIOR ART
FIG. 1 is a schematic sectional view of a conventional attic ventilation structure.

Before the present invention is described in greater detail, it should be noted that same reference numerals have been used to denote like elements throughout the specification.

Figure 4:
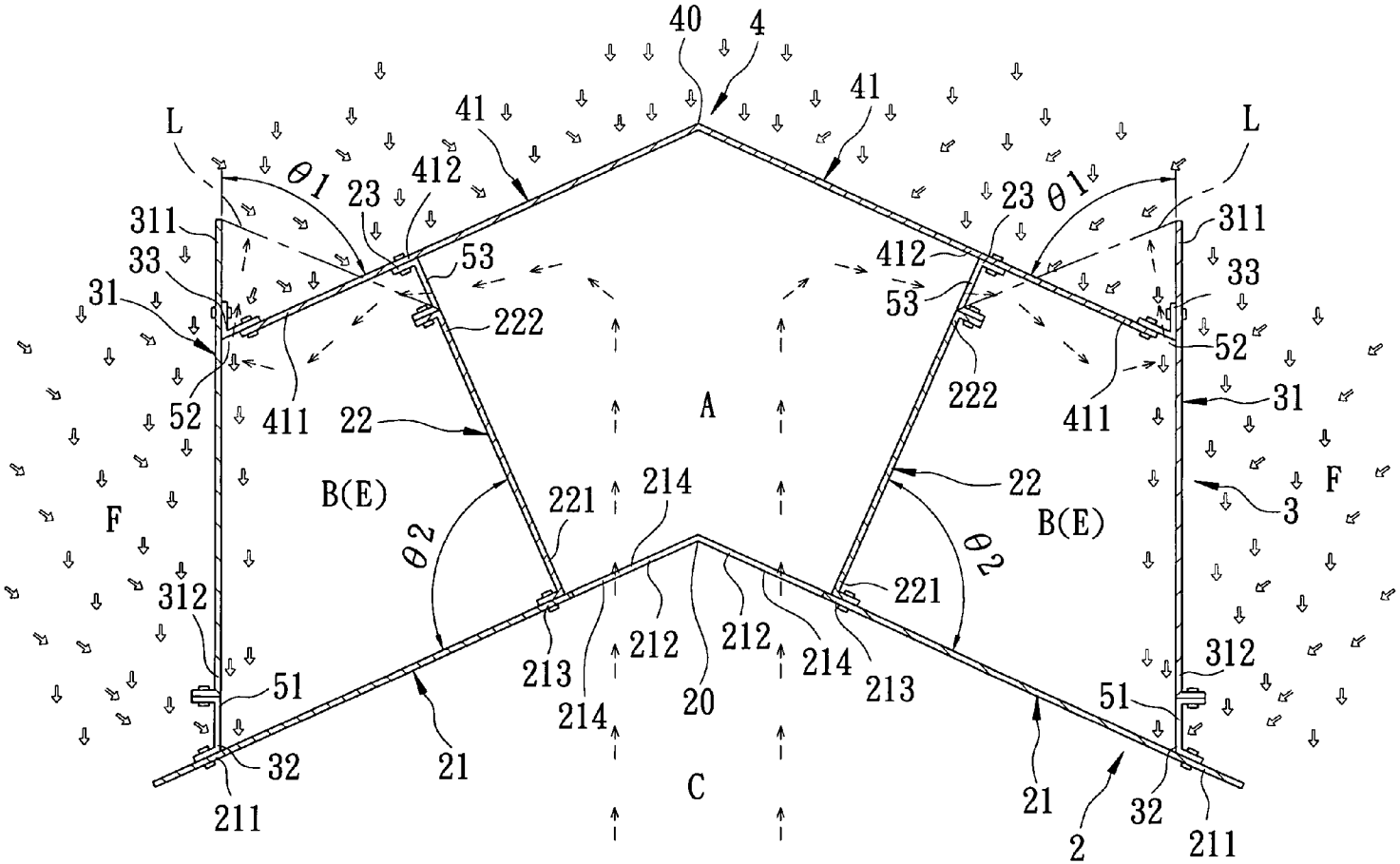
FIG. 4 is a schematic sectional view of the first preferred embodiment of a ventilated roofing structure according to this invention.

Referring to FIG. 4, the first preferred embodiment of a ventilated roofing structure according to the present invention is shown to comprise a modular roofing panel unit 4, a wall unit 2, and a modular drainage-route forming panel unit 3.

In this embodiment, the ventilated roofing structure is formed as an attic that is mounted on top of a building. The modular roofing panel unit 4 is adapted to form part of an outermost layer of a roof, and includes two modular roofing panels 41 which are opposite to each other relative to an outer ridgeline 40 of the roof, which extend outwardly to cover a space thereunder, and which respectively terminate at overhanging eaves 411.

The wall unit 2 includes two modular first wall panels 22 and two modular second wall panels 21. Each of the first wall panels 22 has upper and lower mounting ends 222,221. The upper mounting end 222 is secured to a middle portion 412 of the respective modular roofing panel 41 between the outer ridgeline 40 and the respective overhanging eave 411 by a connector 23, and defines a ventilation opening 53. Thus, the first wall panels 22 partition the space under the roof into an inside space (A) and an outside space (B), and the ventilation openings 53 extend to communicate the inside and outside spaces (A, B). Each of the second wall panels 21 extends downwardly to terminate at an anchored end 211, and is fastened to the lower mounting end 221 of the respective first wall panel 22 at a secured locus 213 that is opposite to the anchored end 211. The second wall panels 21 respectively have panel extensions 212 which extend respectively from the secured loci 213 into the inside space (A) so as to cooperatively form an inner ridgeline 20 that is spaced apart from the outer ridgeline 40 in an upright direction, and which respectively have communicating openings 214 to permit flow of air from a room space (C) under the roof into the inside space (A).

The modular drainage-route forming panel unit 3 includes two modular route forming panels 31. Each route forming panel 31 has an upper end 311 which is fastened to the overhanging eave 411 of the respective roofing panel 41 by an upper adaptor 33 such that a gap 52 is formed between the upper end 311 and the overhanging eave 411, and extends downwards to terminate at an anchoring edge 312 which is secured to the anchored end 211 of the respective second wall panel 21 by a lower adaptor 32 that defines a drainage port 51. The route forming panels 31 are disposed to separate the outside space (B) into an airflow transit chamber (E) and an outdoor space (F) such that the drainage ports 51 extend to communicate the airflow transit chamber (E) with the outdoor space (F). Preferably, the ventilation openings 53 are located higher than the gaps 52. Specifically, the overhanging eave 411 of each roofing panel 41 is located lower than an imaginary line (L) that interconnects a top edge of the upper mounting end 222 of the respective first wall panel 22 and a top edge of the upper end 311 of the respective route forming panel 31. Preferably, each of the route forming panels 31 and the respective roofing panel 41 include an angle (θ1) less than 90 degrees. Each of the second wall panels 21 and the respective first wall panel 22 include an angle (θ2) less than 120 degrees.

Figure 2:
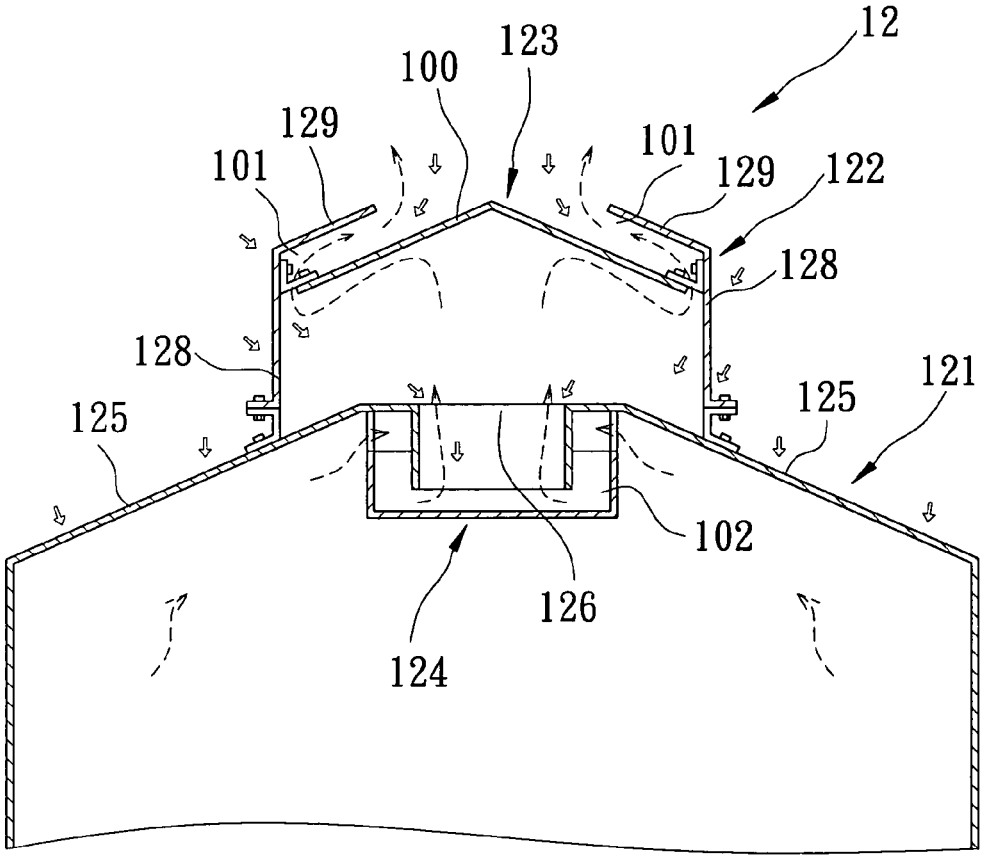
FIG. 2 PRIOR ART
FIG. 2 is a schematic sectional view of another conventional ventilation device.
Figure 3:
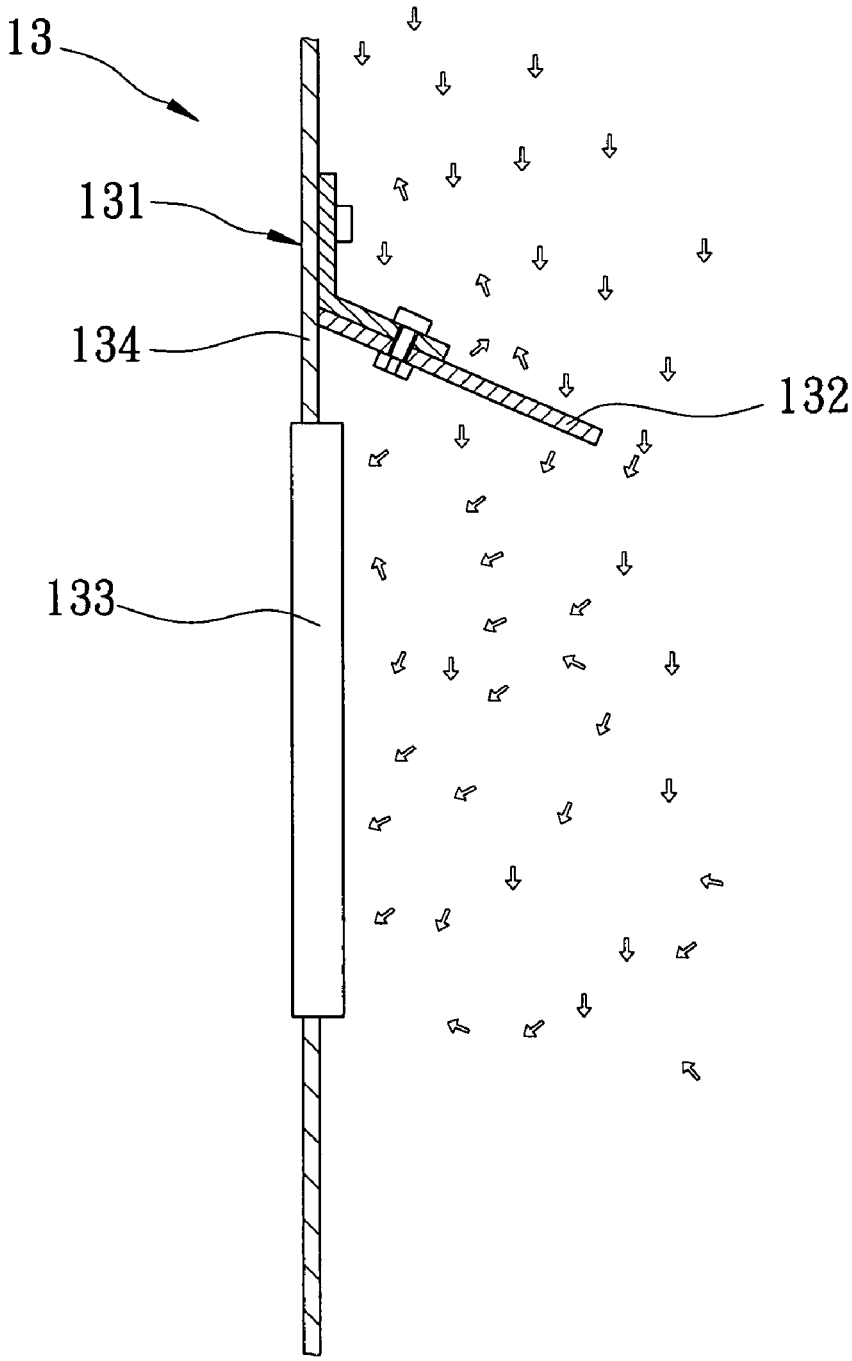
FIG. 3 PRIOR ART
FIG. 3 is a schematic sectional view of still another conventional ventilation device.

In case of a storm, a large amount of rainwater (as indicated by hollow arrows in FIG. 4) can be deflected by the route forming panels 31 and the first wall panels 22, while a small amount of rainwater may fall into the airflow transit chamber (E) through the gaps 52. Rainwater entering the airflow transit chamber (E) is directly drained out through the drainage ports 51. Moreover, heat in the building, i.e., in the room space (C), can be exhausted to the outside, i.e., the outdoor space (F), through the communicating openings 214, the ventilation openings 53, and the gaps 52. Since the paths of airflow in this embodiment assume an S-shape (as indicated by dash arrows in FIG. 4), it is impossible for rainwater to enter the room space (C) along the S-shaped airflow paths. Thus, a good rain-proofing effect can be achieved. On the other hand, heat in the building can be exhausted rapidly along the air flow path. Moreover, since the roofing panel unit 4 is connected to the wall unit 2, and since no tilt panels as those of the conventional ventilation device shown in FIG. 2 are provided on the roofing panel unit 4, stress borne by the roofing panel unit 4 in case of strong winds will be distributed to the wall unit 2 and the drainage-route forming panel unit 3 so that the ventilated roofing structure of the invention as a whole can withstand strong winds. Furthermore, the component parts of the ventilated roofing structure according to this invention can be configured to be modular and therefore can be manufactured at relatively low costs.

Figure 5:
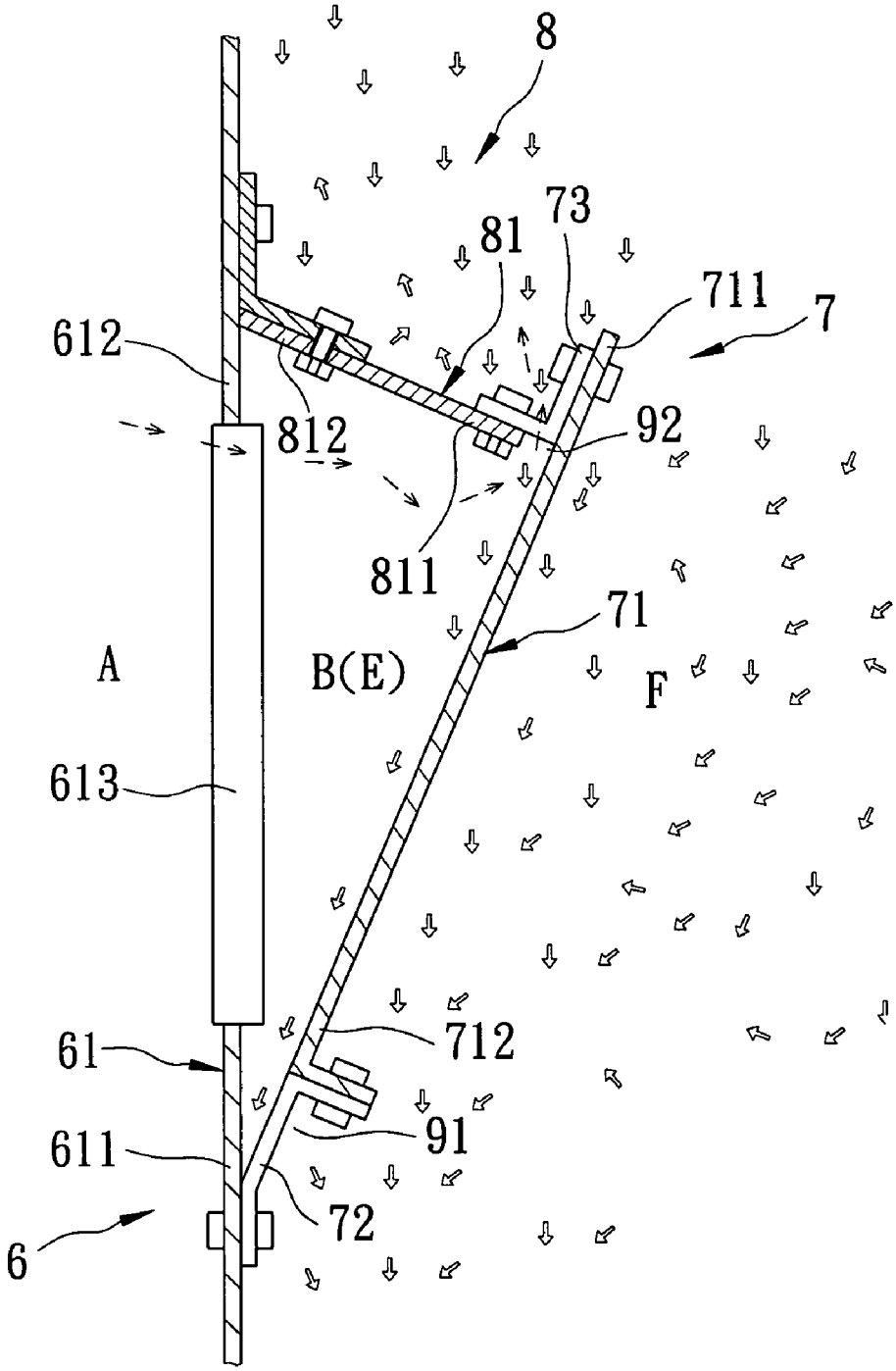
FIG. 5 is a schematic sectional view of the second preferred embodiment of a ventilated roofing structure according to this invention.

Referring to FIG. 5, the second preferred embodiment of a ventilated roofing structure according to this invention is adapted to be mounted on an exterior wall of a building, and comprises a modular roofing panel unit 8, a wall unit 6, and a modular drainage-route forming panel unit 7.

The wall unit 6 includes a wall panel 61 which extends in an upright direction to form part of the exterior wall of the building, and which has a mounting end 612 spaced apart from an anchored end 611 in the upright direction by a ventilation opening 613 that forms a window in the exterior wall. The modular roofing panel unit 8 includes a roofing panel 81 which has a higher connecting end 812 that is opposite to an overhanging eave 811 and that is secured to the mounting end 612 of the wall panel 61. The modular drainage-route forming panel unit 7 includes a route forming panel 71 having an upper end 711 and an anchoring edge 712 opposite to each other, and a lower adaptor 72 which connects the anchored end 611 with the anchoring edge 712 to define a drainage port 91 located lower than the ventilation opening 613. In addition, the upper end 711 is connected to the overhanging eave 811 by an upper adaptor 73 such that a gap 92 is formed between the upper end 711 and the overhanging eave 811. Therefore, by virtue of the provision of the route forming panel 71, rainwater can be deflected so that it cannot enter the inside space (A) through the ventilation opening 613. Some rainwater falling into the airflow transit chamber (E) can be drained out through the drainage port 91.

Figure 6:
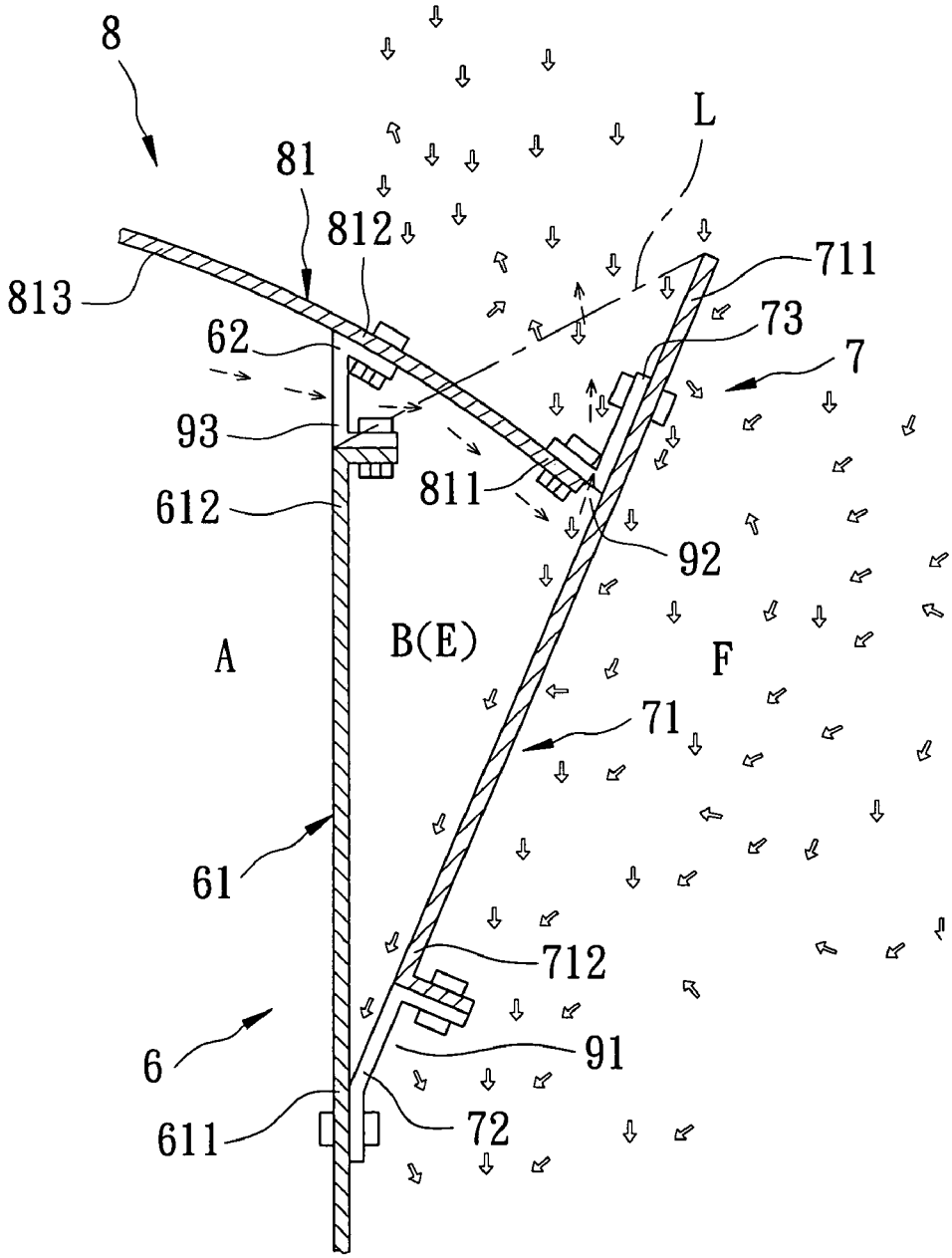
FIG. 6 is a schematic sectional view of the third preferred embodiment of a ventilated roofing structure according to this invention.

Referring to FIG. 6, the third preferred embodiment of a ventilated roofing structure according to this invention is similar to the second preferred embodiment in construction. The structure of the third embodiment is adapted to be mounted on an open roof of a building. In the third embodiment, the modular roofing panel unit 8 includes a modular roofing panel 81 which is disposed upwardly of and spaced apart from a wall panel 61 of the wall panel unit 6 by a ventilation opening 93. Specifically, the wall unit 6 includes a connector 62 which is connected to the roofing panel 81, and which defines the ventilation opening 93. In addition, similar to the second embodiment, a lower adaptor 72 is disposed to connect the anchored end 611 of the wall panel 61 to an anchoring edge 712 of a route forming panel 71 of the modular drainage-route forming panel unit 7 and defines the drainage port 91. The upper end 711 of the route forming panel 71 is connected to the overhanging eave 811 of the roofing panel 81 by an upper adaptor 73 such that a gap 92 is formed between the upper end 711 and the overhanging eave 811. In this embodiment, the ventilation opening 93 is located higher than the gap 92. Specifically, the overhanging eave 811 of the roofing panel 81 is located lower than an imaginary line (L) that interconnects a top edge of the mounting end 612 and a top edge of the upper end 711. Therefore, the airflow path in this embodiment has an S-shape (as indicated by dash arrows in FIG. 6), and it is impossible for rainwater to enter the inside space (A) along the S-shaped airflow path. Thus, a good rain-proofing effect can be achieved.

Figure 7:
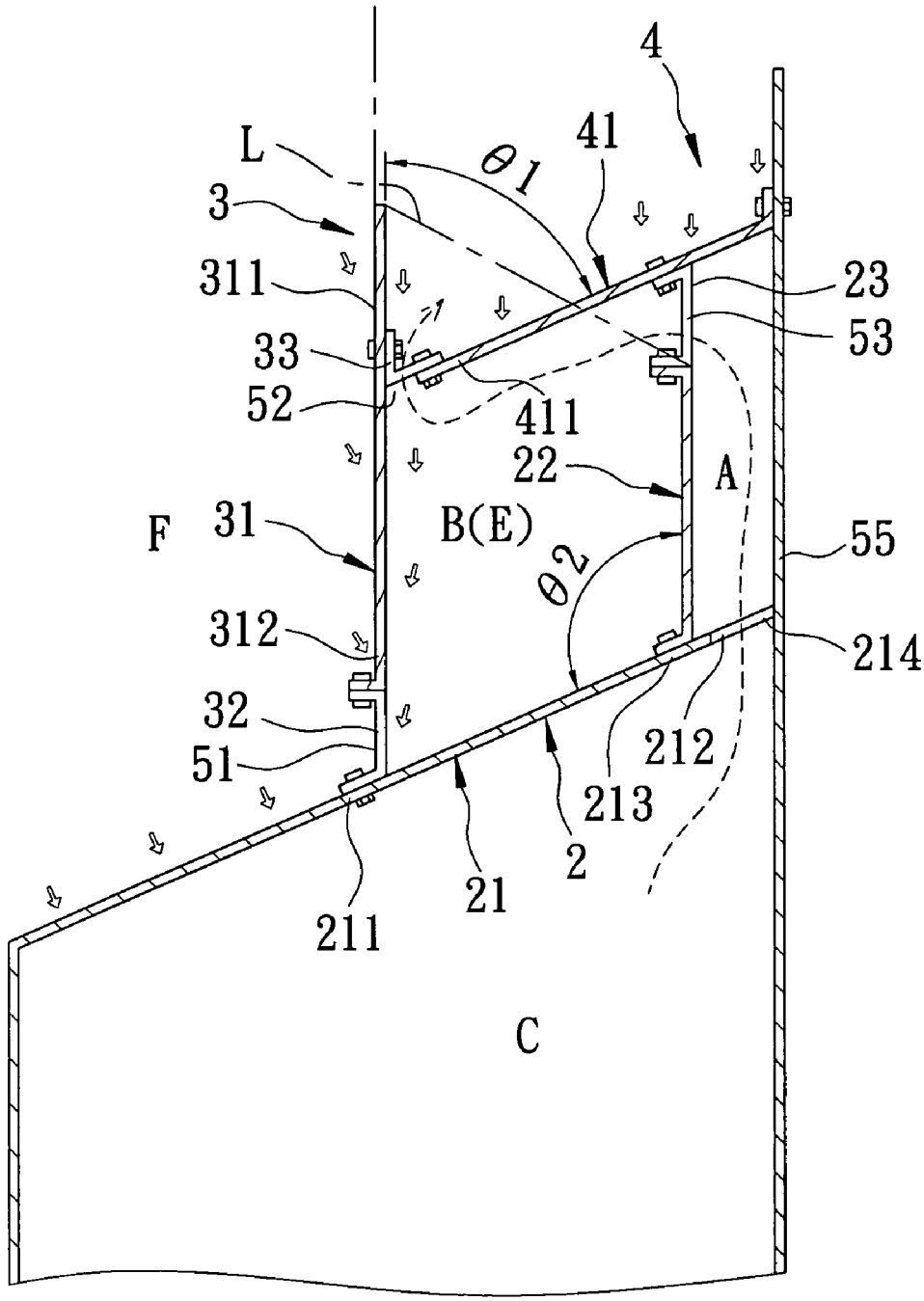
FIG. 7 is a schematic sectional view of the fourth preferred embodiment of a ventilated roofing structure according to this invention.

Referring to FIG. 7, the fourth preferred embodiment of a ventilated roofing structure according to this invention is similar to the first preferred embodiment in construction, and comprises a modular roofing panel unit 4 including a modular roofing panel 41, a wall unit 2 including a first wall panel 22, a second wall panel 21, and a third wall panel 55, and a modular drainage-route forming panel unit 3 including a modular route forming panel 31.

The first wall panel 22 is secured to the roofing panel 41, and defines a ventilation opening 53. The second wall panel 21 has an anchored end 211, and is fastened to the first wall panel 22 at a secured locus 213 that is opposite to the anchored end 211. The second wall panel 21 further has a panel extension 212 which extends from the secured locus 213 into the inside space (A) and which has a communicating opening 214 to permit flow of air from a room space (C) under the roof into the inside space (A). In this embodiment, the third wall panel 55 forms a part of the exterior wall of the building, extends in an upright direction, and is secured to the roofing panel 41 and the panel extension 212. The route forming panel 31 and the roofing panel 41 include an angle (θ1) that is less than 90 degrees. The second wall panel 21 and the first wall panel 22 include an angle (θ2) that is less than 120 degrees. The overhanging eave 411 of the roofing panel 41 is located lower than an imaginary line (L) that interconnects a top edge of the first wall panel 22 and a top edge of the route forming panel 31. Thus, the airflow path in this embodiment has an S-shape (as indicated by dash arrows in FIG. 7), and it is impossible for rainwater to enter the inside space (A) along the S-shaped airflow path.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A ventilated roofing structure, comprising:

a modular roofing panel unit which is adapted to form part of an outermost layer of a roof, which extends outwardly and downwardly to cover a space thereunder, and which terminates at an overhanging eave;

a wall unit which is secured to said modular roofing panel unit distal from said overhanging eave, which extends downwardly to terminate at an anchored end, and which is disposed to partition the space under the roof into outside and inside spaces, said wall unit being configured to have a ventilation opening that extends to communicate the inside and outside spaces; and a modular drainage-route forming panel unit having an upper end which is fastened to said overhanging eave with an adaptor such that a gap is formed between said drainage route forming panel unit and said overhanging eave, said modular drainage-route forming panel unit extending downwards to separate the outside space into an airflow transit chamber and an outdoor space, and terminating at an anchoring edge which is secured directly to said anchored end, said modular drainage-route forming panel unit being configured to have a drainage port which is disposed proximate to said anchored end, and which extends to communicate the airflow transit chamber with the outdoor space.

2. The ventilated roofing structure according to claim 1, wherein said modular roofing panel unit includes two modular roofing panels opposite to each other relative to an outer ridgeline of the roof, each of said roofing panels having said overhanging eave, said wall unit including two modular first wall panels respectively secured to said modular roofing panels, each of said first wall panels having said ventilation opening, and two modular second wall panels, each having said anchored end, said second wall panels being respectively fastened to said first wall panels at two secured loci that are respectively opposite to said anchored ends of said second wall panels, said second wall panels further respectively having panel extensions which extend respectively from said secured loci into said inside space so as to cooperatively form an inner ridgeline that is spaced apart from the outer ridgeline in an upright direction, and which have communicating openings to permit flow of air from a room space under the roof into the inside space;

said modular drainage-route forming panel unit including two modular route forming panels, each of which has said upper end that is fastened to said overhanging eave of a respective one of said roofing panels so as to form said gap, said anchoring edge that is secured to said anchored end of a respective one of said second wall panels, and said drainage port that is disposed proximate to said anchored end of the respective one of said second wall panels.

3. The ventilated roofing structure according to claim 2, wherein said ventilation opening is located higher than said gap.

4. The ventilated roofing structure according to claim 2, wherein said overhanging eave of each of said roofing panels is located lower than an imaginary line that interconnects a top edge of a respective one of said first wall panels and a top edge of said upper end of a respective one of said route forming panels;

each of said route forming panels and a respective one of said roofing panels including an angle that is less than 90 degrees;

each of said second wall panels and a respective one of said first wall panels including an angle less than 120 degrees.

5. The ventilated roofing structure according to claim 2, wherein said modular drainage-route forming panel unit includes two lower adaptors, each connecting said anchored end of a respective one of said second wall panels to said anchoring edge of a respective one of said route forming panels and defining said drainage port, and two upper adaptors, each connecting said upper end of a respective one of said route forming panels to said overhanging eave of a respective one of said roofing panels;

each of said first wall panels including a connector which is connected to a respective one of said roofing panels and which defines said ventilation opening.

6. The ventilated roofing structure according to claim 1, wherein said wall unit extends in an upright direction, and has a mounting end spaced apart from said anchored end in the upright direction by said ventilation opening, said modular roofing panel unit being secured to said mounting end.

7. The ventilated roofing structure according to claim 6, wherein said modular drainage-route forming panel unit includes a lower adaptor connecting said anchored end with said anchoring edge and defining said drainage port, the ventilated roofing structure further comprising an upper adaptor connecting said upper end to said overhanging eave.

8. The ventilated roofing structure according to claim 1, wherein said modular roofing panel unit is disposed upwardly of and is spaced apart from said wall panel unit by said ventilation opening, said ventilation opening being located higher than said gap.

9. The ventilated roofing structure according to claim 8, wherein said modular drainage-route forming panel unit includes a lower adaptor connecting said anchored end to said anchoring edge and defining said drainage port, the ventilated roofing structure further comprising an upper adaptor connecting said upper end to said overhanging eave, said wall unit including a connector which is connected to said modular roofing panel unit, and which defines said ventilation opening.

10. The ventilated roofing structure according to claim 1, wherein said wall unit includes a first wall panel which is secured to said roofing panel unit and which has said ventilation opening, a second wall panel which has said anchored end and which is fastened to said first wall panel at a secured locus that is distal from said anchored end, said second wall panel further having a panel extension which extends from said secured locus into said inside space and which has a communicating opening to permit flow of air from a room space under the roof into the inside space, and a third wall panel which extends in an upright direction and which is secured to said roofing panel unit and said panel extension;

said drainage-route forming panel unit and said roofing panel unit including an angle that is less than 90 degrees;

said second wall panel and said first wall panel including an angle that is less than 120 degrees.

* * * * *